US008857808B2

(12) United States Patent
Matsumoto

(10) Patent No.: US 8,857,808 B2
(45) Date of Patent: Oct. 14, 2014

(54) MEDIUM CONVEYANCE APPARATUS AND IMAGE FORMING APPARATUS

(71) Applicant: Oki Data Corporation, Tokyo (JP)

(72) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/717,994

(22) Filed: Dec. 18, 2012

(65) Prior Publication Data

US 2013/0161897 A1 Jun. 27, 2013

(30) Foreign Application Priority Data

Dec. 21, 2011 (JP) ..... 2011-279369

(51) Int. Cl.

| | |
|---|---|
| ***B65H 3/44*** | (2006.01) |
| ***B65H 5/26*** | (2006.01) |
| ***B65H 1/08*** | (2006.01) |
| ***G03G 15/00*** | (2006.01) |

(52) U.S. Cl.

CPC ..... *B65H 3/44* (2013.01); *G03G 15/6514* (2013.01); *B65H 2405/324* (2013.01); *B65H 2407/21* (2013.01)

USPC ..... 271/9.09; 271/127

(58) Field of Classification Search

CPC ..... B65H 2405/324; B65H 2407/21; B65H 3/44; G03G 2215/00392; G03G 15/66514

USPC ..... 271/9.09, 127, 162, 145; 399/392

See application file for complete search history.

(56) References Cited

U.S. PATENT DOCUMENTS

| | | | | |
|---|---|---|---|---|
| 5,419,544 | A * | 5/1995 | Ono et al. | 271/164 |
| 5,857,671 | A * | 1/1999 | Kato et al. | 271/10.11 |
| 5,913,510 | A * | 6/1999 | Kiyohara et al. | 271/4.01 |
| 7,306,217 | B2 * | 12/2007 | Bandou et al. | 271/145 |
| 7,360,959 | B2 * | 4/2008 | Sawada et al. | 400/642 |
| 7,553,099 | B2 * | 6/2009 | Bandou et al. | 400/624 |
| 7,668,501 | B2 * | 2/2010 | Murakami et al. | 399/392 |
| 7,731,170 | B2 * | 6/2010 | Nishii et al. | 271/9.09 |
| 7,866,655 | B2 * | 1/2011 | Uehara | 271/9.09 |
| 7,926,804 | B2 * | 4/2011 | Chinzei et al. | 271/162 |
| 7,971,866 | B2 * | 7/2011 | Huang et al. | 271/9.01 |
| 8,002,269 | B2 * | 8/2011 | Asada et al. | 271/145 |
| 8,087,658 | B2 * | 1/2012 | Ohtsuki | 271/9.09 |
| 8,118,296 | B2 * | 2/2012 | Nishii et al. | 271/9.09 |

FOREIGN PATENT DOCUMENTS

| | | | |
|---|---|---|---|
| JP | S57-85552 | U | 5/1982 |
| JP | S62-11844 | U | 1/1987 |
| JP | H07-17650 | A | 1/1995 |
| JP | H07-304549 | A | 11/1995 |

(Continued)

*Primary Examiner* — Patrick Cicchino

(74) *Attorney, Agent, or Firm* — Panitch Schwarze Belisario & Nadel LLP

(57) ABSTRACT

A medium conveyance apparatus used in an image forming apparatus, includes a medium mounting unit held at a body or apparatus frame for mounting a medium, a conveying member supported rotationally around an axis to the body for conveying the medium, and a separating member being held at the body and contacting with the conveying member. The medium mounting unit includes an engaging portion for engaging the body, whereas the body or apparatus frame includes an engaged portion to be engaged with the engaging portion, and the engaging portion includes a contacting portion for regulating the body or apparatus frame in a conveyance direction of the medium. This medium conveyance apparatus maintains improved medium conveyance capability for a long period.

18 Claims, 14 Drawing Sheets

(56) References Cited

FOREIGN PATENT DOCUMENTS

| | | | |
|---|---|---|---|
| JP | H09-20444 | A | 1/1997 |
| JP | 2010-102124 | A | 5/2010 |
| JP | 2010-228832 | A | 10/2010 |
| JP | 2011-013429 | A | 1/2011 |

* cited by examiner (a)

(b)

(a)

(b)

(a)

(b)

(c)

(a)

(b)

(a)

(b)

(a)

(b)

(a)

(b)

(a)

(b)

MEDIUM CONVEYANCE APPARATUS AND IMAGE FORMING APPARATUS

CROSS REFERENCE TO RELATED APPLICATION

This application claims priority benefits under 35 USC, section 119 on the basis of Japanese Patent Application No. 2011-279369, the disclosure of which is incorporated herein by reference.

BACKGROUND OF THE INVENTION

1. Field of the Invention

This invention relates to a medium conveyance apparatus for manual feeding tray of an image forming apparatus.

2. Description of Related Art

In conventional medium conveyance apparatuses and image forming apparatuses, a medium mounting unit is attached to an apparatus body. Japanese Patent Application Publication No. 2010-228832 discloses such a medium mounting unit (particularly, 6 page, FIG. 1).

With such an apparatus, it is not easy to render medium conveyance stable for a long time at a time that media are fed out of the medium mounting unit, so that improvements in conveyance performance are in need.

SUMMARY OF THE INVENTION

A medium conveyance apparatus according to the invention includes a medium mounting unit held at a body for mounting a medium, a conveying member supported rotationally around an axis to the body for conveying the medium, and a separating member being held at the body and contacting with the conveying member, wherein the medium mounting unit includes an engaging portion for engaging the body, wherein the body includes an engaged portion to be engaged with the engaging portion, and wherein the engaging portion includes a contacting portion for regulating the body in a conveyance direction of the medium.

According to the medium mounting unit of the invention, conveyance performance is improved because deviation of positional relationship among respective parts of the apparatus can be suppressed from changing by means of flexure from weight exertion occurring during medium conveyance.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIG. 2(*a*) shows a closed state in which the manual feed tray cover is closed; FIG. 2(*b*) shows an open state in which the manual feed tray cover is open;

FIG. 7(*a*) shows a state that the apparatus frame and the manual feed tray cover having a paper mounting plate are separated from each other; FIG. 7(*b*) shows the manual feed tray cover excluding the paper mounting plate;

FIG. 8(*b*) is a partly enlarged view of a circled portion drawn by a single dot chain line in FIG. 8(*a*); FIG. 8(*c*) is a partly enlarged view of a projecting portion;

FIG. 9(*b*) is a partly enlarged view of a circled portion drawn by a single dot chain line in FIG. 9(*a*);

FIG. 13(*b*) is a partly enlarged view of a circled portion drawn by a single dot chain line in FIG. 13(*a*)

DETAILED DESCRIPTION OF THE INVENTION

First Embodiment

Figure 1:
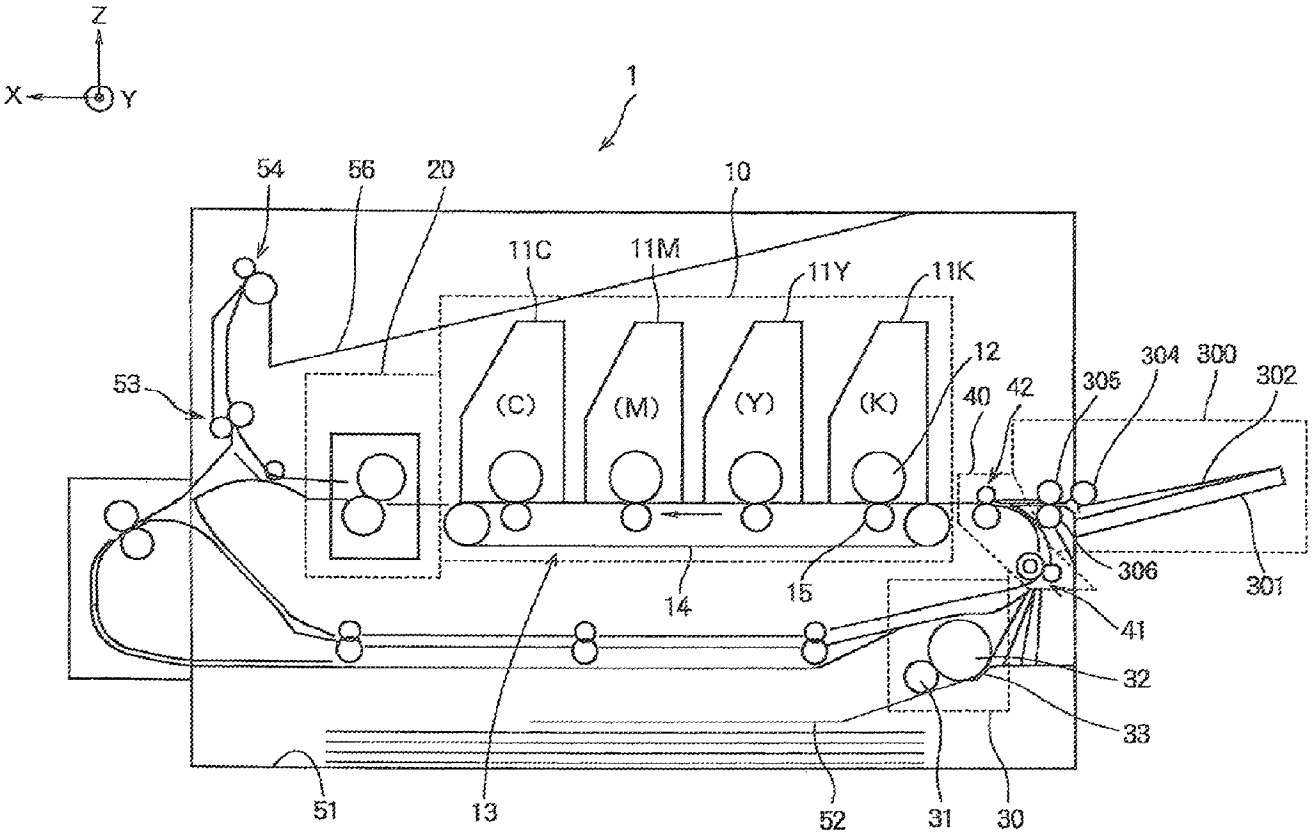
FIG. 1 is a schematic structural view, when seen from their front, of essential portions of an image forming apparatus according to a first embodiment in which a medium mounting unit according to this invention applies.

FIG. 1 is a schematic structural view, when seen from their front, of essential portions of an image forming apparatus according to the first embodiment in which a medium mounting unit according to this invention applies.

In FIG. 1, a paper tray 51 stacking recording paper 52 inside is disposed at an inside lower part of an image forming apparatus 1 having a structure as an electrophotographic printer, and a paper feeding unit 30 for feeding the recording paper 52 as a medium sheet by sheet is arranged on a paper feeding side of the paper tray 51. The paper feeding unit 30 is formed with a pickup roller 31 arranged to press the recording paper 52 lifted up to a certain level, a feed roller separating sheet by sheet the recording paper 52 fed by the pickup roller 31, and a separation piece 33.

Figure 2:
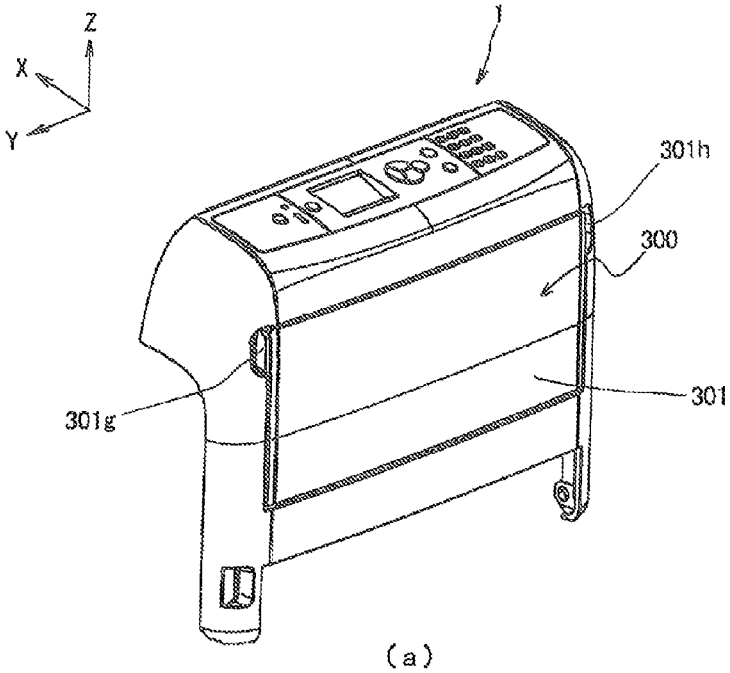
FIGS. 2(*a*), (*b*) are appearance perspective views, when seen from an upper oblique direction, showing an manual feed tray and its vicinity of the image forming apparatus.
Figure 2:
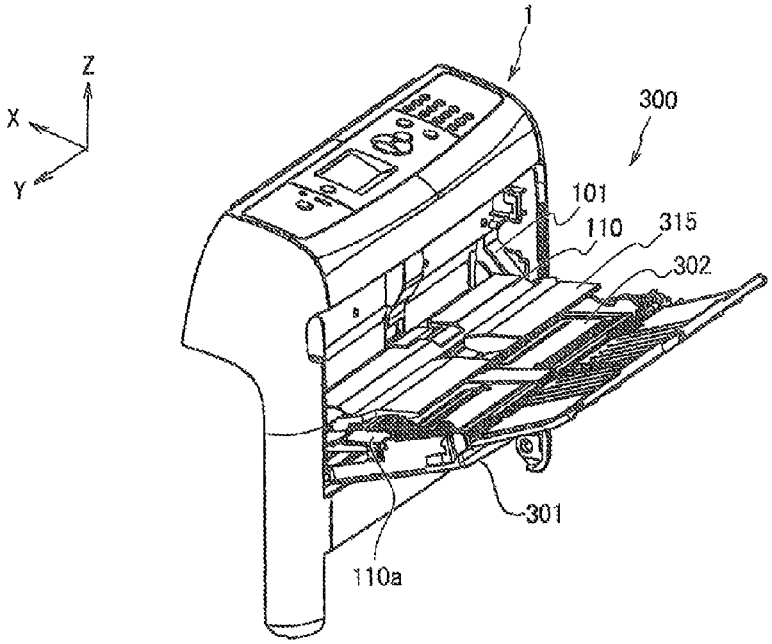

A manual feed tray 300 is formed with a paper mounting plate 302 mounting recording paper 370 (see, FIG. 10), a manual feed tray cover 301 rotationally holding the paper mounting plate 302, a pickup roller 304 arranged to be pressed by a contacting portion of the paper mounting plate 302, a holding member 110, as shown in FIG. 2(*b*), for holding the pickup roller 304, a feed roller 305 and a retard roller 305 for separating sheet by sheet the paper fed by the pickup roller 304, etc. The recording paper 370 on the paper mounting plate 302 is fed to the feed roller 305 upon revolution of the pickup roller 304 driven by a motor, not shown, and separated sheet by sheet by the feed roller 304 and the retard roller 305, and transferred to a paper conveying unit 40. The manual feed tray cover 301 and the paper mounting plate 302 serve as the medium mounting unit.

The paper conveying unit 40 made of pairs of conveying rollers 41, 42 conveys a recording paper 52 fed as a single sheet taken from the paper feeding unit 30 to an image forming unit 10 via the conveying roller pairs 41, 42, and conveys the recording paper 370 (FIG. 10) fed as a single sheet taken from the manual feed tray 300 to the image forming unit 10 via the conveying roller pair 42 in substantially the same way. The image forming unit 10 includes four toner image forming units 11K, 11Y, 11M, 11C arranged in series in the order from an upstream side in the conveyance direction of the recording paper (hereinafter, occasionally referred simply to as "the toner image forming unit 11" in a case that no distinction among the units is needed), and a transfer unit 13 for transferring toner images formed with the toner image forming unit 11 onto an upper surface of the paper by coulomb force The toner image forming unit 11K forms toner mages in black (K); the toner image forming unit 11Y forms toner mages in yellow (Y); the toner image forming unit 11M forms toner mages in magenta (M); the toner image forming unit 11C forms toner mages in cyan (C). Each toner image forming unit 11 charges a photosensitive drum 12 with a charging roller, not shown, writes image data on the rotating photosensitive drum 12 with a light emitting head, not shown, and develops the image data with the toner agent, thereby obtaining toner images in each color on the photosensitive drum 12.

The transfer unit 13 includes a transfer belt 14 conveying the recording paper 52 conveyed from the paper tray 51 and the recording paper 370 (FIG. 10) conveyed from the manual feed tray 300 in an arrow direction, and four transfer rollers 15 disposed as to face respective photosensitive drums 12 of the toner image forming units 11 through the transfer belt 14. The transfer unit 13 transfers toner images in respective colors formed on the photosensitive drum 12 of the respective toner image forming unit 11 to the recording paper 52, 370 sequentially in an overlaying manner with coulomb force.

A fixing unit 20 fixes, to the recording paper 52, 370, toner images transferred on the recording paper 52, 370 at the transfer unit 13 with heat and pressure, and the recording paper 52, 370 to which the toner images are fixed are ejected to a stacking unit 56 for stacking the already printed recording paper via a conveying roller pair 53 and a delivery roller pair 54.

Regarding each axis of X, Y, and Z in FIG. 1, X axis extends in the conveyance direction of the recording paper 52, 370 at a time that the recording paper 52, 370 passes through the image forming unit 10 or development forming unit; Y axis extends in a direction of a rotation axis of the photosensitive drum 12; Z axis extends in a direction perpendicular to those axes. In other drawings described below, where the respective axes of X, Y, and Z are shown, the axial directions of those are common with those in FIG. 1. That is, the X, Y, and X axes in the respective drawings show directions of the arrangement at a time that the image forming apparatus 1 is structured as shown in FIG. 1 in terms of illustrated parts in the respective drawings. It is assumed herein that the image forming apparatus 1 is so arranged that the Z axis extends in the substantially vertical direction.

Figure 3:
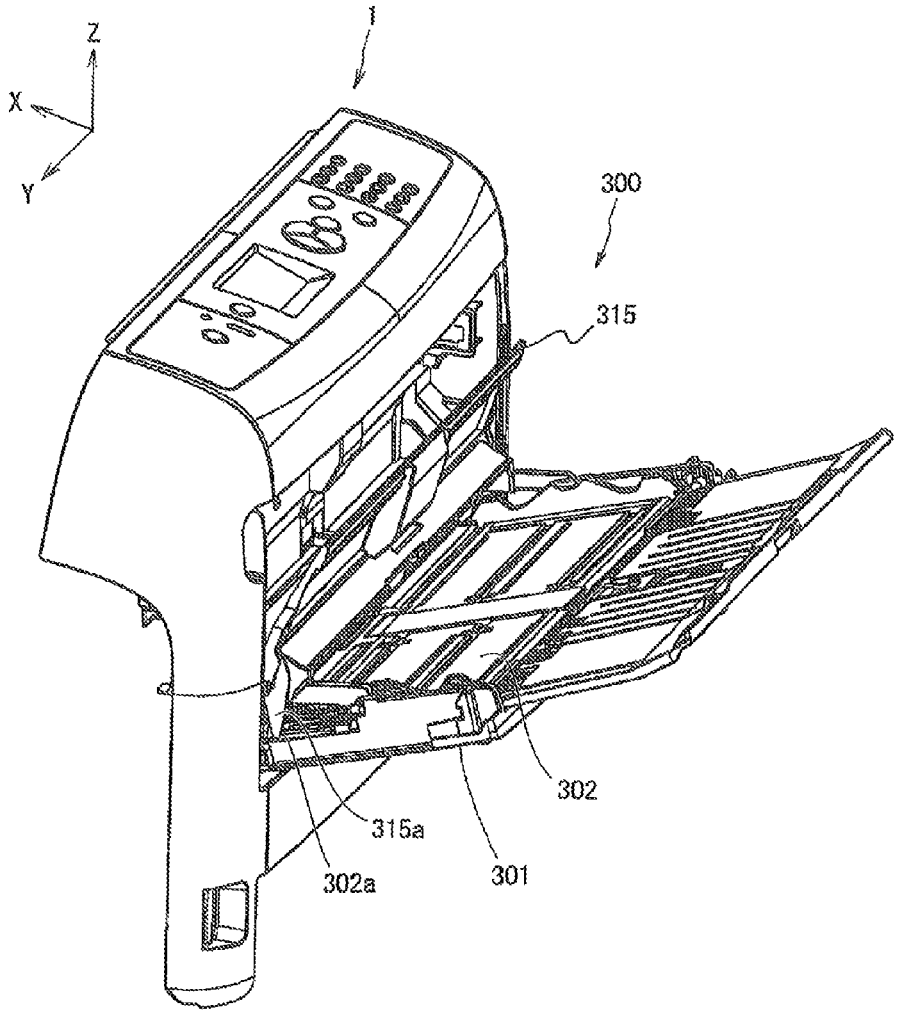
FIG. 3 is diagram showing a state that the manual feed tray is in the open state and further that the lever is in a pulled up state.

FIGS. 2(*a*), 2(*b*) are appearance perspective views, when seen from an upper oblique direction, showing the manual feed tray 300 and its vicinity of the image forming apparatus 1; FIG. 2(*a*) shows a closed state in which the manual feed tray cover 301 is closed, for containing the manual feed tray 300; FIG. 2(*b*) shows an open state in which the manual feed tray cover 301 is open, for using the manual feed tray 300. FIG. 3 shows a state that the manual feed tray 300 is in the open state and a lever 315 is pulled up.

As shown in FIG. 2(*b*), the manual feed tray cover 301 is arranged pivotally to an apparatus frame 101 serving as a frame member secured to the housing of the image forming apparatus 1 as described below and moves pivotally between an open position of the open state and a closed position of the closed state. The paper mounting plate 302 is arranged pivotally to the manual feed tray cover 301 as described below and mounts thereon the recording paper serving as the recording medium.

In this embodiment, the manual feed tray 300 and the apparatus frame 101 of the image forming apparatus 1 are equivalent to a medium conveyance apparatus, and the portions other than the medium conveyance apparatus may be referred to as the housing of the image forming apparatus 1. The housing of the image forming apparatus 1 corresponds to a body, whereas the manual feed tray cover 301 and the paper mounting plate 302 are equivalent to the medium mounting unit. The open position of the manual feed tray cover 301 corresponds to the operational position whereas the closed portion corresponds to the retracted position.

Figure 7:
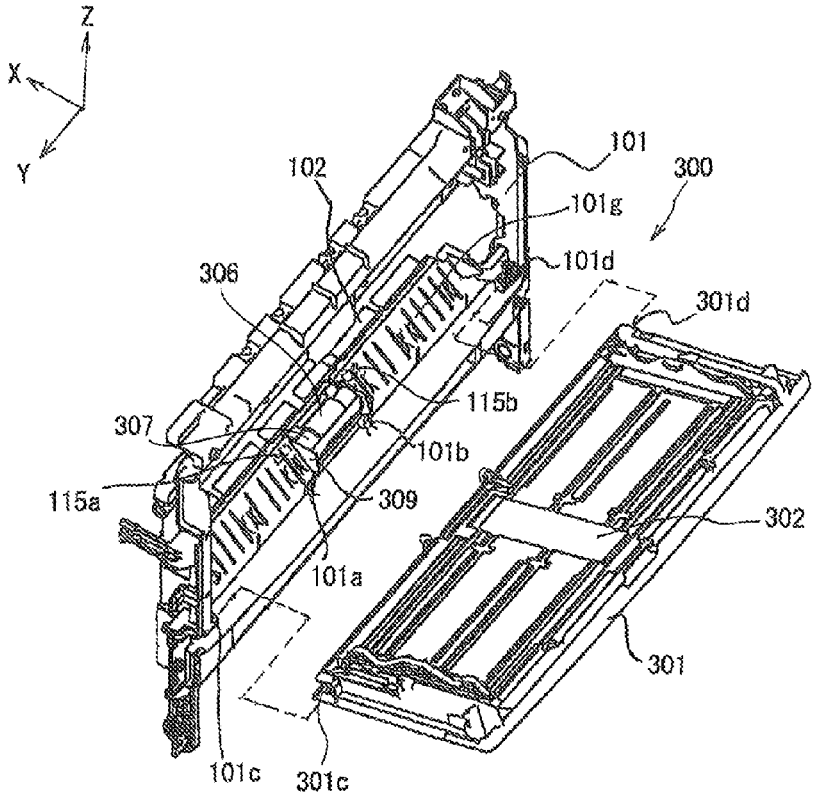
FIGS. 7(*a*), (*b*) are assembly illustrations for describing an assembling relation between the apparatus frame and a manual feed tray cover.
Figure 7:
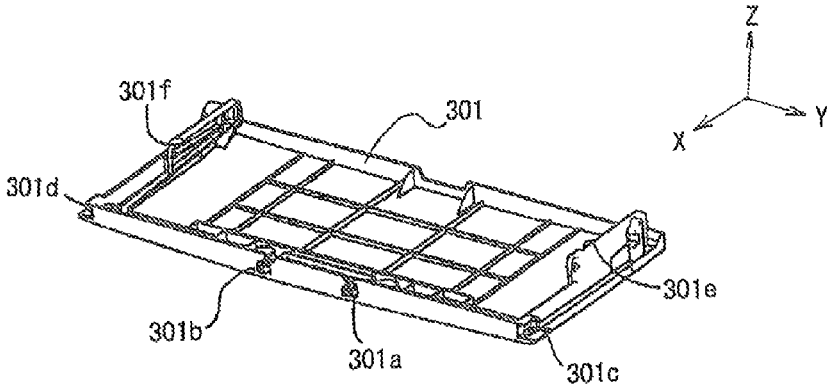

The holding member 110 is held pivotally to the apparatus frame 101, and a top portion of a pair of arms 110*a*, 110*b* (only 110*a* shown in FIG. 2) formed on each of the right and left sides fits slidably to guide grooves 301*e*, 301*f* (see, FIG. 7(*b*)) respectively formed at a corresponding position of the manual feed tray cover 301, thereby restricting the pivotal range of the manual feed tray cover 301. The lever 315 is held pivotally to the holding member 110, and as shown in FIG. 3, an arm 315*a* of the lever 315 fits a groove 302*a* of the paper mounting plate 302 upon pivotal movement of the lever 315, thereby moving up and down the paper mounting plate 302. Those structures are described in detail below.

Figure 4:
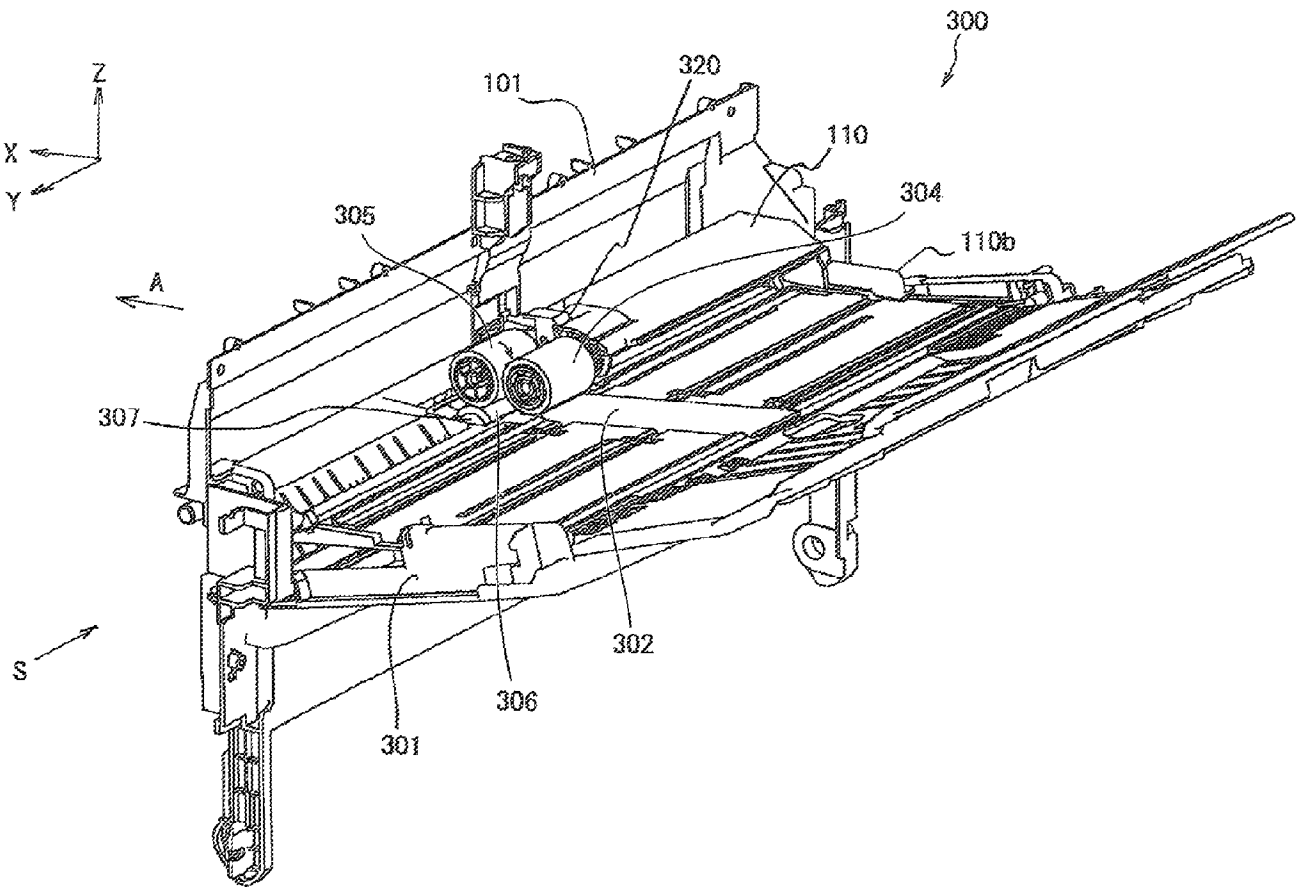
FIG. 4 is a perspective view showing essential structures of the manual feed tray in the open state and an apparatus frame.
Figure 5:
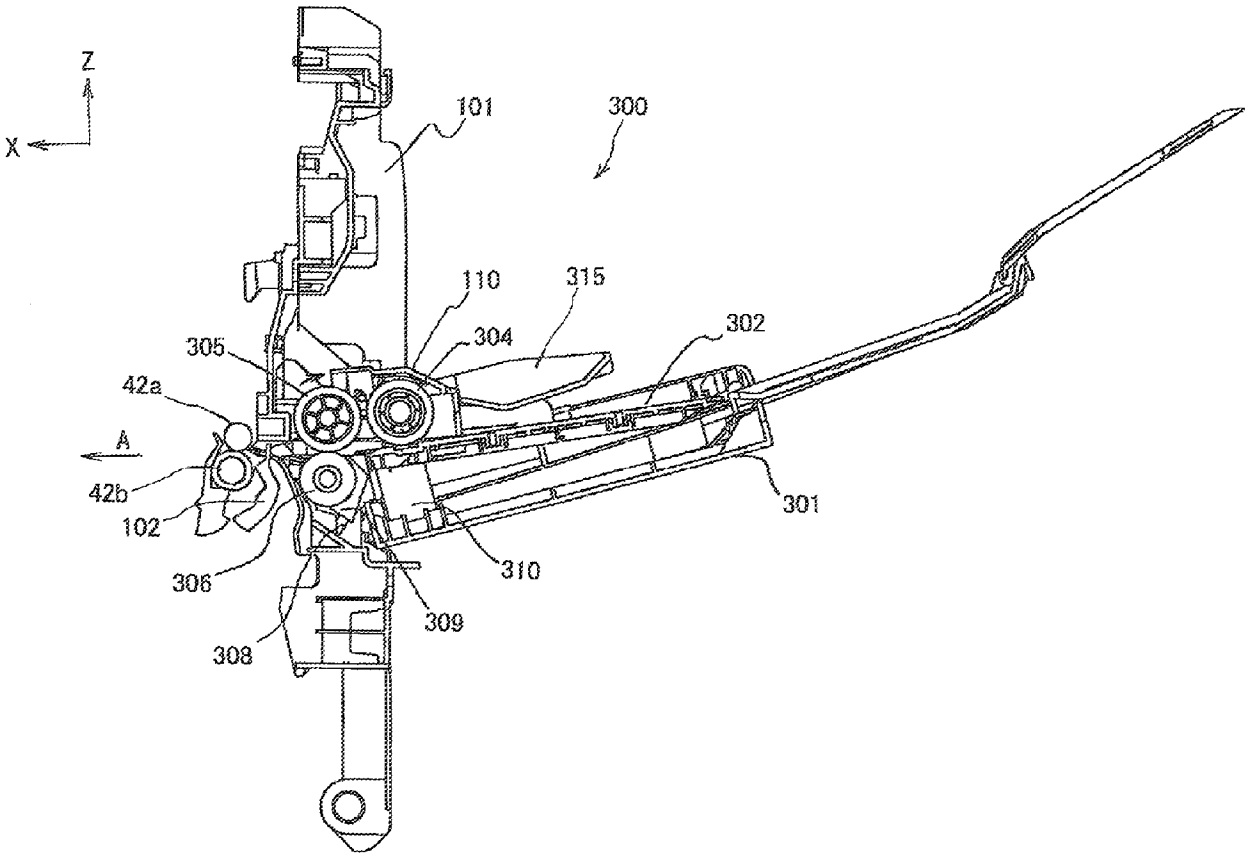
FIG. 5 is an essential structural view showing the manual feed tray and the apparatus frame when seen from an arrow S direction in FIG. 4.

FIG. 4 is a perspective view showing essential structures of the manual feed tray 300 in the open state and the apparatus frame 101; FIG. 5 is an essential structural view showing the manual feed tray 300 and the apparatus frame 101 when seen from the arrow S direction or Y-axis plus direction in FIG. 4. FIG. 4 omits a part of the holding member 110 and the lever 315.

In FIG. 4, the pickup roller 304 is held rotationally to the holding member 110 and is arranged to make pressurized contact with a contact portion located at a center in a widthwise direction of the paper mounting plate 302, on a tip side in an arrow A direction showing the conveyance direction of the paper. A rear end side of the paper mounting plate 302 in the arrow A direction is held pivotally by the manual feed tray cover 30, and the contact portion is urged to the pickup roller 304 by a spring 310 (FIG. 5) disposed in a space between the pickup roller 304 and the manual feed tray cover 301 in a contracted state below the contact portion contacting to the pickup roller 304. The spring 310 serves as an urging member.

The feed roller 305 serving as a conveying member is provided rotationally at the apparatus frame 101, located adjacently on a downstream side of the pickup roller 304 in the arrow A direction during this open state, and driven to rotate in the arrow direction with a drive motor not shown via an electromagnetic clutch not shown.

The holding member 110 rotationally holding the pickup roller 304 is pivotally held, coaxially with the feed roller 305, to the apparatus frame 101. The pickup roller 304 and the feed roller 305 are coupled by an idle roller 320 rotationally held to the holding member 110. The pickup roller 304 rotates in the same direction as rotation of and in accompanying with the feed roller 305, and the holding member 110 is structured to be movable around the pickup roller 304 as being coupled to the feed roller 305 in accompanying with pivotal movements of the holding member 110 (see, e.g., FIG. 8(*a*)).

Figure 6:
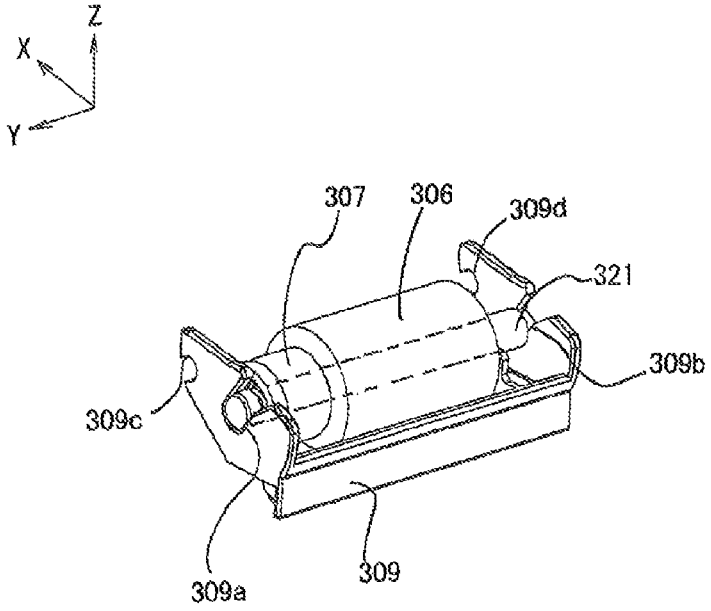
FIG. 6 is an appearance perspective view showing structures of a retard roller and a retard frame holding the retard roller.

A retard roller 306 as a separating member is disposed below the feed roller 305. FIG. 6 is an appearance perspective view showing structures of the retard roller 306 and a retard frame 309 holding the retard roller 306.

As shown in FIG. 6, the retard roller 306 is attached to a rotation axis 321 via a torque limiter 307 and is secured to the retard frame 309 where the rotation axis 321 has each end inserted with pressure into bearing long groove pair 309*a*, 309*b* formed in the retard frame 309. The retard roller 306, when receiving rotational force from the exterior, rotates in the same direction in producing a certain rotation load by the torque limiter 307.

The retard frame 309 is formed with bearing grooves 309*c*, 309*d* fitting to axis portion pair 115*a*, 115*b* (see, FIG. 7) formed at the apparatus frame 101, and is attached pivotally to the apparatus frame 101 below the retard roller 305. The pivotal axis of the retard frame 309 and the rotation axis of the retard roller 306 are structured commonly to be parallel to the rotation axis of the feed roller 305. The retard roller 306, while being in a state attached to the apparatus frame 101, is urged to make a pressurized contact with the feed roller 305 by a spring 308 arranged in a contracted state between the retard frame 309 and the apparatus frame 101 as shown in FIG. 5.

A pair of conveyance roller 42*a*, 42*b* constitutes conveying roller pair 42 for conveying the recording paper 51 fed from the paper feeding unit 30 (FIG. 1) and the recording paper 370 fed from the manual feed tray 300, is attached rotationally to the body of the image forming apparatus 1, and is driven by a drive motor not shown. A paper guide 102 is arranged at the apparatus frame 101 and positionally shifts according to either the recording paper 51 fed from the paper feeding unit 30 (FIG. 1) or the recording paper 370 fed from the manual feed tray 300, thereby guiding those recording papers smoothly to the conveying roller pair 42.

FIGS. 7(*a*), (*b*) are assembly illustrations for describing an assembling relation between the apparatus frame 101 and the manual feed tray cover 301; FIG. 7(*a*) shows a state that the apparatus frame 101 and the manual feed tray cover 301 having a paper mounting plate 302 are separated from each other; FIG. 7(*b*) shows the manual feed tray cover 301 excluding the paper mounting plate 302. In FIGS. 7(*a*), (*b*), the holding member 110 pivotally held to the apparatus frame 101 for holding the pickup roller 304, the lever 315 held to the holding member 110, and the feed roller 305 rotationally held at the apparatus frame 101, etc. are omitted.

As shown in FIG. 7(*b*), the manual feed tray cover 301 is formed with, in an opposing fashion, a pair of pivotal axis holes 301*c*, 301*d* disposed on the pivotal axis, a pair of projecting portions 301*a*, 301*b* fitting to fitting portions 101*a*, 101*b* formed near the right and left sides of the retard frame 309 arranged at the apparatus frame 101, and a pair of guide grooves 301*e*, 301*f* receiving each tip portion of the pair of the arms 110*a*, 110*b* formed at respective sides of the holding member 110 and guiding each tip portion slidably. The projecting portions 301*a*, 301*b* serve as engaging portions whereas the fitting portions 101*a*, 101*b* serve as engaged portions. To the contrary, as shown in FIG. 7(*a*), the apparatus frame 101 is formed with rotation supporting portions 101*c*, 101*d* fittingly inserted into the pivotal axis holes 301*c*, 301*d* of the manual feed tray cover 301 to hold pivotally the manual feed tray cover 301 around a shaft center provided parallel to the rotation shaft of the retard roller 306.

In this embodiment, exemplified is a structure in which each member of the manual feed tray 300 is attached to the apparatus frame 101 secured to the body of the image forming apparatus 1, but this invention is not limited to this. A structure may be possible in which each member is directly attached to the body of the image forming apparatus 1.

Figure 8:
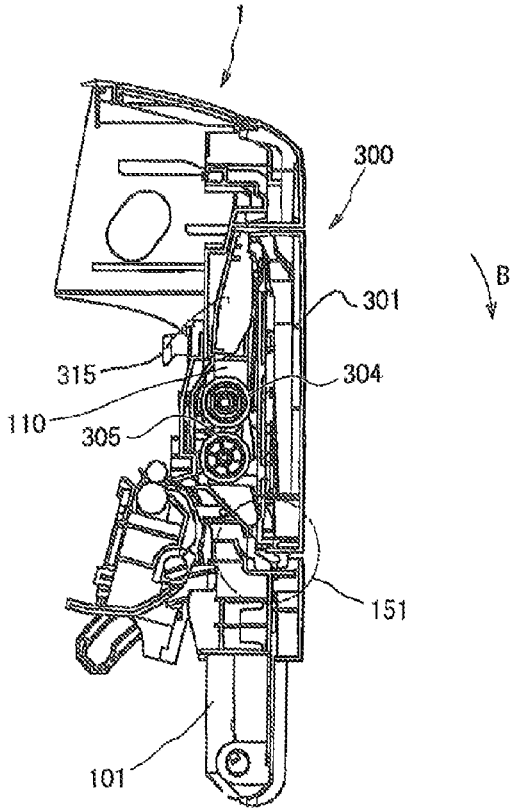
FIG. 8(*a*) is a structural view showing essential structures of the medium conveyance apparatus in which the manual feed cover is in the closed position.
Figure 8:
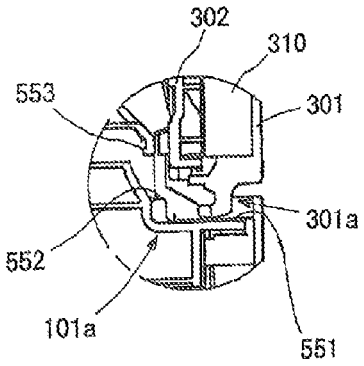
Figure 8:
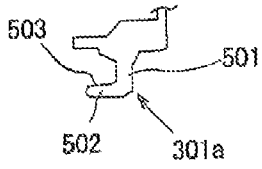
Figure 9:
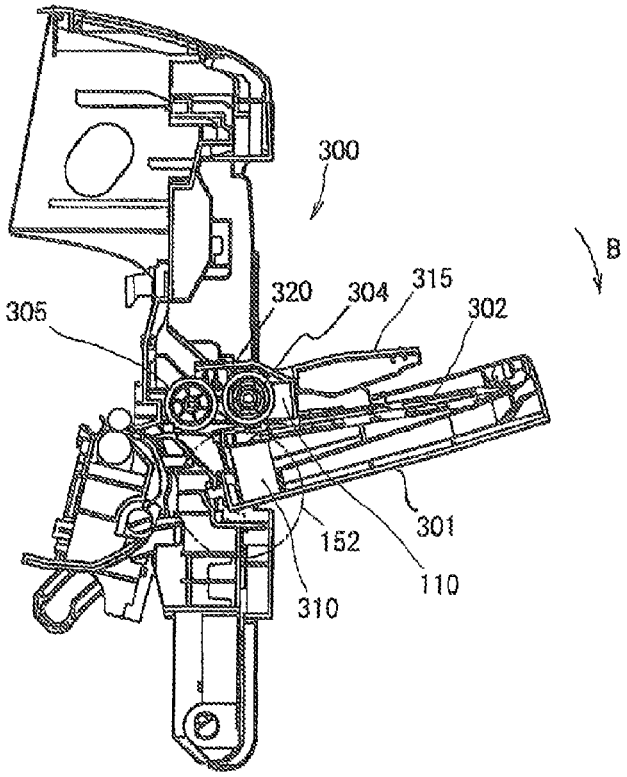
FIG. 9(*a*) is a structural view showing essential structures of the medium conveyance apparatus in which the manual feed cover is in the open position.
Figure 9:
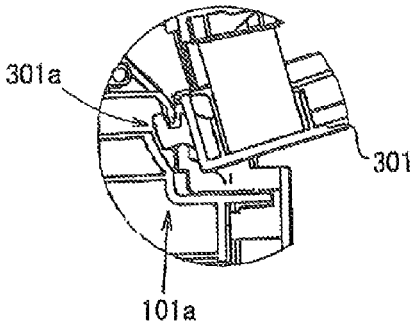

With the structure described above, first, operation at a time that the manual feed tray cover 301 moves from the closed position shown in FIG. 2(*a*) to the open position shown in FIG. 2(*b*), is described. FIG. 8(*a*) is a structural view showing essential structures of the medium conveyance apparatus in which the manual feed tray cover 301 is in the closed position; FIG. 8(*b*) is a partly enlarged view of a circled portion 151 drawn by a single dot chain line in FIG. 8(*a*); FIG. 8(*c*) is a partly enlarged view of the projecting portion 301*a*. FIG. 9(*a*) is a structural view showing essential structures of the medium conveyance apparatus in which the manual feed tray cover 301 is in the open position; FIG. 9(*b*) is a partly enlarged view of a circled portion 152 drawn by a single dot chain line in FIG. 9(*a*).

Where the manual feed tray 300 is in the closed state as shown in FIG. 8(*a*), the manual feed tray cover 301 held pivotally to the apparatus frame 101 extends substantially vertically, and pivotal movements is locked by a locking mechanism not shown in a manner that the cover's surface forms the same surface as that of the body of the image forming apparatus 1. The holding member 110, pivotally held to the apparatus frame 101, in which the tip portions of the arms 110*a*, 110*b* (FIG. 2, FIG. 4) thereof engage the guide grooves 301*e*, 301*f* (FIG. 7(*b*)) of the manual feed tray cover 301, stays at a pivotal portion at which the pickup roller 304 for holding is positioned above the feed roller 305, in accordance with the manual feed tray cover 301, and is contained inside the manual feed tray cover 301 together with the lever 315, which is held pivotally to the holding member 110 and positioned above the feed roller 305 in accordance with the holding member 110.

From this situation, if e.g., an operator unlocks the mechanism by manipulation of pulling portions 301*g*, 301*h* (see, FIG. 2(*a*)) to pull the manual feed tray cover 301 toward the front side, the manual feed tray cover 301 moves pivotally in arrow B direction with the rotation supporting portions 101*c*, 101*d* of the apparatus frame 101 as a pivotal center. The paper mounting plate 302 at that time moves together because attached to the manual feed tray cover 301. The holding member 110 moves pivotally in arrow B direction along pivotal movement of the manual feed tray cover 301 while the tip portions of the arms 110*a*, 110*b* fitting into the guide grooves 301*e*, 301*f* of the manual feed tray cover 301 move in the pivotal axis direction along the guide grooves 301*e*, 301*f*, and the feed roller 305 and the lever 315 held at the holding member also move in the same way.

As the manual feed tray cover 301 further moves in arrow B direction, the tip portions of the arms 110*a*, 110*b* of the holding member 110 come in contact with ends of the guide grooves 301*e*, 301*f* of the manual feed tray cover 301 in the pivotal axis direction to stop the manual feed tray cover 301 moving pivotally in arrow B direction, thereby rendering the manual feed tray 300 in the open state as shown in FIG. 9. The pickup roller 304 moves to a position shown in FIG. 9 and contacts with pressure to the contact portion of the paper mounting plate 302 urged by the spring 310.

Where the manual feed tray 300 is in the open state as shown in FIG. 9, the operator moves pivotally the lever 315 in a direction opposite to arrow B, thereby pulling down the paper mounting plate 302 in opposing urging force of the spring 310 by the arm 315*a* as shown in FIG. 3, and thereby maintaining the paper mounting plate 302 in a pulled down state by fitting the arm 315*a* into the groove 302*a* of the paper mounting plate 302. With this mechanism, recording papers 370 in a prescribed number can be stored in a stacking manner on the paper mounting plate 302 between the plate 302 and the pickup roller 304. By returning the lever 315 back to the original pivotal position in moving pivotally in arrow B direction, the paper mounting plate 302 make a pressurized contact with the pickup roller 304 via the topmost surface of the stacked recording papers 370, thereby rendering possible conveyance of the recording papers.

Next, a relationship between the pair of the projecting portions 301*a*, 301*b* of the manual feed tray cover 301 and the fitting portions 101*a*, 101*b* formed at the apparatus frame 101 in association with the transition from the closed state to the open state of the manual feed tray 300 described above is further described. Because the projecting portions 301*a*, 301*b* are in the same shape whereas the fitting portions 101*a*, 101*b* are in the same shape, a relationship between the projecting portion 301*a* and the fitting portion 101*a* is described herein.

As shown in FIGS. 8(*b*), 8(*c*), and 9(*b*), the projecting portion 301*a* is formed in a letter-L shape, and is having an extension portion 501 extending from an end near the pivotal axis (corresponding to the pivotal axis holes 301*c*, 301*d*, herein) of the manual feed tray 301, and a contact portion 502 extending from the extension portion 501 in substantially the right angle (or around 70 to 120 degrees herein) toward the paper mounting surface side, and a contacting surface 503, serving as a contacting portion, is formed inside the contact portion 502. On the other hand, the fitting portion 101*a* includes a guide portion 551 for guiding the projecting portion 301*a*, an opening 552, into which the projecting portion 301*a* is inserted, formed on an inner side of the guide portion 551, and a contacted surface 553 serving as a contacted portion, to which the contacting surface 503 of the projecting portion 301*a* is contacted, formed near an inner side of the opening 552. It is to be noted that the inner side of the opening 552 is a surface opposite to an outer surface 101*g* of the apparatus frame 101 shown in FIG. 7.

With the structure described above, as shown in FIG. 8(*b*), where the manual feed tray cover 301 is in the closed position of the closed state, the projecting portion 301*a* is located to a position of the guide portion 551 of the fitting portion 101*a*; as pivotal movement of the manual feed tray cover 301 in arrow B direction, the extension portion 501 and the contact portion 502 of the projecting portion 301*a* enter into the opening 552 of the fitting portion 101*a*; further as shown in FIG. 9(*b*), where the manual feed tray cover 301 reaches the open position in the open state, the contacting surface 503 of the projecting portion 301*a* comes in a state contacting to the contacted surface 553 of the fitting portion 101*a*. Thus, it is structured that the contacting surface 503 and the contacted surface 553 are in contact with one another with prescribed force where the manual feed tray 300 reaches the open position of the open state. This is the same as in the relationship between the projecting portion 101*b* and the fitting portion 101*b*.

From this contact, the position of the retard roller 306 is limited in the paper conveyance direction as described below. The position of the manual feed tray 301 in the pivotal axis direction (Y-axis direction) with respect to the apparatus frame 101 can be limited by forming, e.g., the width of the opening 552 in the pivotal axis direction (Y axis direction) and the width of the projecting portion 301*a* to be contained in the opening 552 with substantially no gap in the open state.

Figure 10:
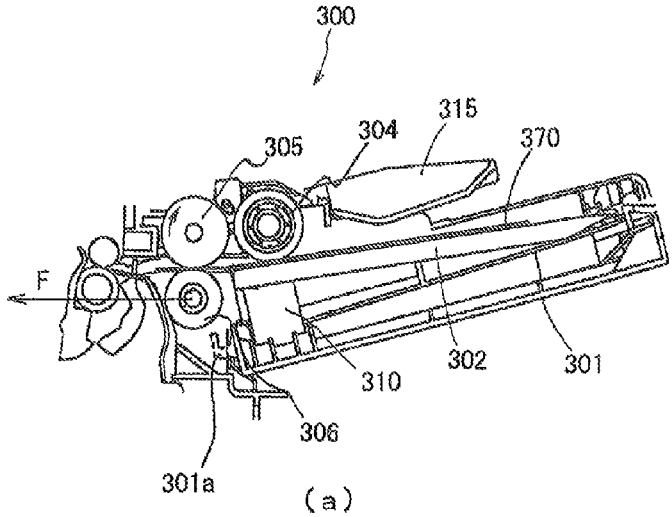
FIGS. 10(*a*), 10(*b*) are diagrams for illustrating paper feeding operation.
Figure 10:
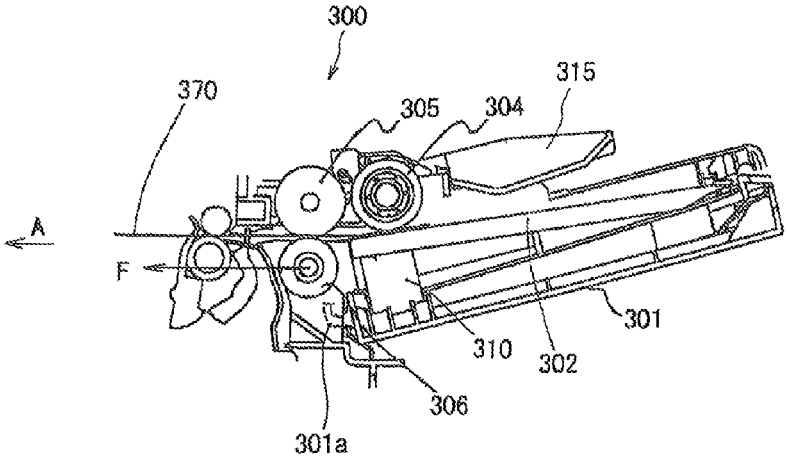
Figure 11:
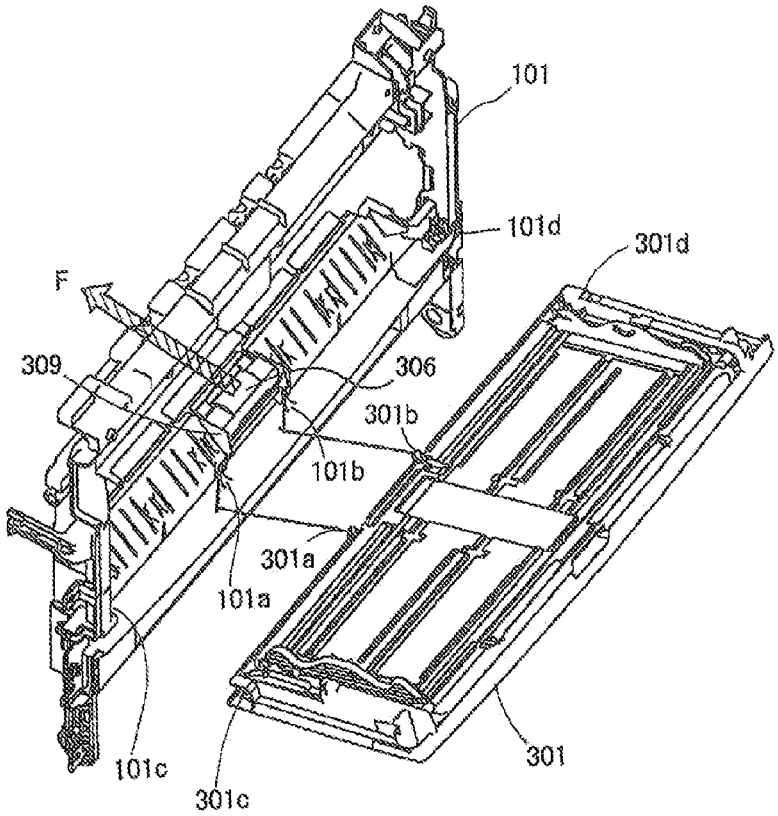
FIGS. 11(*a*), 11(*b*) are diagrams for illustrating effects on each part during the paper feeding operation.
Figure 11:
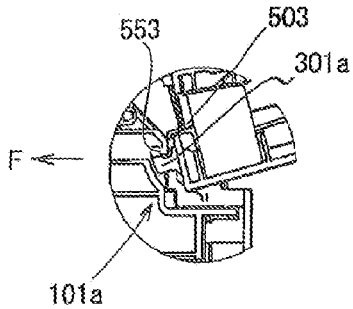

Next, referring to FIG. 10 and FIG. 11, operation of the paper conveyance apparatus and effects of each parts thereof at a time feeding the recording paper 370 stacked on the paper mounting plate 302, are further described. FIGS. 10(*a*), 10(*b*) are diagrams for illustrating paper feeding operation; FIGS. 11(*a*), 11(*b*) are diagrams for illustrating effects on each part during the paper feeding operation.

When the recording paper 370 stacked on the paper mounting plate 302 is fed, the feed roller 305 is driven to rotate in an arrow direction by a drive motor not shown via an electromagnetic clutch not shown, and according to this movement, the pickup roller 304 also rotates in the same direction, thereby feeding the recording paper 370 on a side of the body of the image forming apparatus 1 on arrow A direction. At that time, a prescribed rotation load occurs by means of a torque limiter 307 (FIG. 6) at the retard roller 306 in pressurized contact with the feed roller 305, and if plural recording papers is about to enter between the feed roller 305 and the retard roller 306, the recording paper contacting the feed roller 305 only is conveyed in overcoming frictions among the papers, thereby prohibiting the recording paper located lower than the contacting sheet from entering by the retard roller 306.

Where the recording paper 370 of a single sheet is conveyed in a manner thus described in arrow A direction between the feed roller 305 and the retard roller 306, the retard roller 306 rotates as producing rotation loads in being driven from the feed roller 305, so that the retard roller 306 receives force of load F in the same direction as the paper conveyance direction. Because the retard roller 306 has bearings with the retard frame 309, and because the retard frame 309 has bearings with apparatus frame 101, the force of load F exerts to the apparatus frame 101 at a center in the width direction (arrow Y direction) of the apparatus frame 101 attaching the retard frame 309.

Although the recording paper 370 fed thus in arrow A direction is further fed to the image forming unit 10 with conveying roller pair 42 (FIG. 1), the drive to the feed roller 305 is cut off by the electromagnetic clutch not shown when the recording paper 370 reaches the image forming unit 10. Accordingly respective rollers rotate jointly along transfer of the recording paper 370 while the recording paper 370 exists between the feed roller 305 and the retard roller 306. During this period, similar force of load F also exerts to the retard roller 306 producing rotation load, and the apparatus frame 101 also receives the force of load F at the center thereof in substantially the same way. The force of load F works to bend the apparatus frame 101 at that time.

If the apparatus frame is bent, separation capability for the recording paper 307 to be conveyed is reduced because positional relationship between the retard roller 306 and the feed roller 305 is changed. Paper jamming may occur because the paper guide 102 attached to the apparatus frame 101 positionally shifts to change the paper conveyance route to the conveying roller pair 42.

With the medium conveyance apparatus in this embodiment, as shown in FIGS. 11(*a*), 11(*b*), because the contacted surface 553 formed at the apparatus frame 101 contacts the contacting surface 502 formed at the manual feed tray cover 301, the force of load F is transmitted to the manual feed tray cover 301 and further transmitted to the pair of rotation supporting portions 101*c*, 101*d* formed on each side of the apparatus frame 101 for supporting the manual feed tray cover 301 at its axis. The load F occurring at the retard roller is therefore dispersed at the center and each side of the apparatus frame 101 and exerted in directions toward those, thereby mostly suppressing force bending the apparatus frame 101.

It is preferable that engagements between the projecting portion 301*a* and the fitting portion 101*a* and between the projecting portion 301*b* and the fitting portion 101*b* are done near the retard roller 306 from those reasons. Herein, the fitting portion 101*a* is disposed near the bearing long groove 309*a* (FIG. 6) of the retard roller 306 whereas the fitting portion 101*b* is disposed near the bearing long groove 309*b* (FIG. 6) of the retard roller 306.

For easy transmission of the load F exerted to the retard roller 306, via the manual feed tray cover 301 to the rotation supporting portions 101*c*, 101*d*, it is preferable, in this open state, for the extension portion 501 of the projecting portion 301 a (FIG. 8(*c*)) to extend along a virtual line extending from a pivotal center axis of the tray cover 301 toward the conveyance direction (arrow A direction) of the recording paper. This is substantially the same as for projecting portion 301*b*.

It is to be noted that although the retard roller 306 producing a prescribed rotation load for serving as a separating member is used in this embodiment, the invention is not limited to this structure, and a non-rotational member such as the separation piece 33 of the paper feeding unit 30 can be used.

As described above, according to the medium conveyance apparatus of the first embodiment, load occurring during conveyance of the recording paper prevents the apparatus frame 101 from bending, so that performances in separation and conveyance of the recording paper can be settled for a long period.

Second Embodiment

Figure 12:
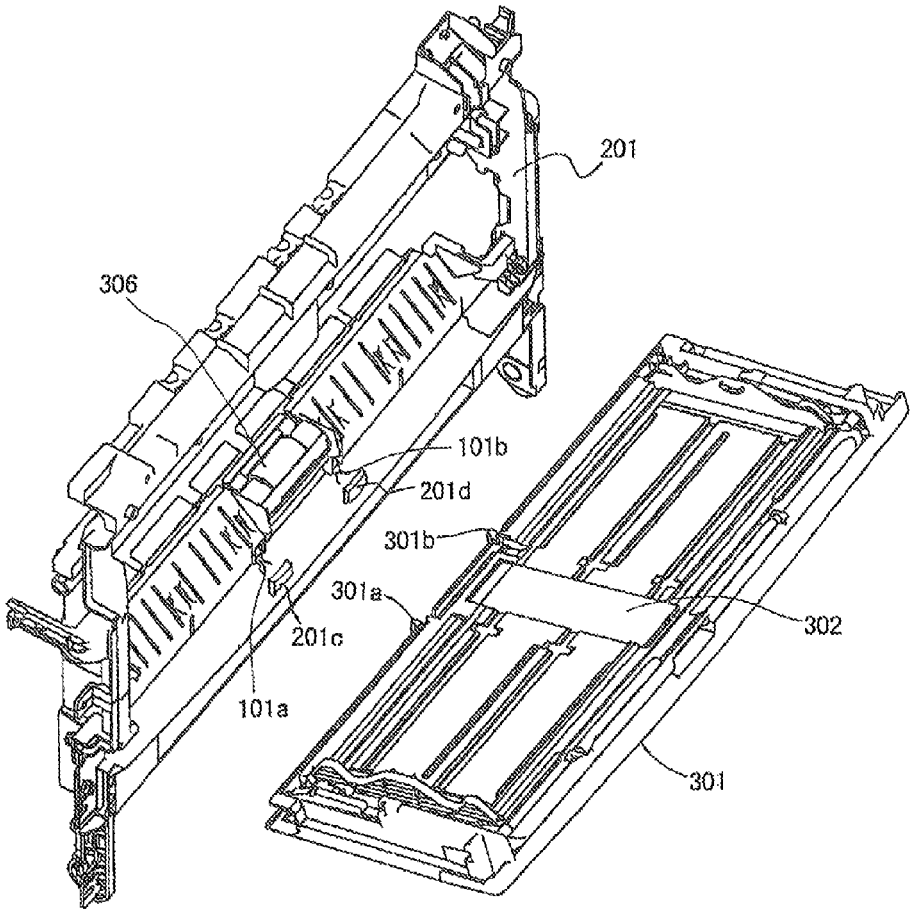
FIG. 12 is an assembly illustration for describing an assembling relation between an apparatus frame and a manual feed tray cover in a medium conveyance apparatus according to a second embodiment, showing a state that the apparatus frame and the manual feed tray cover having a paper mounting plate are separated from each other.
Figure 13:
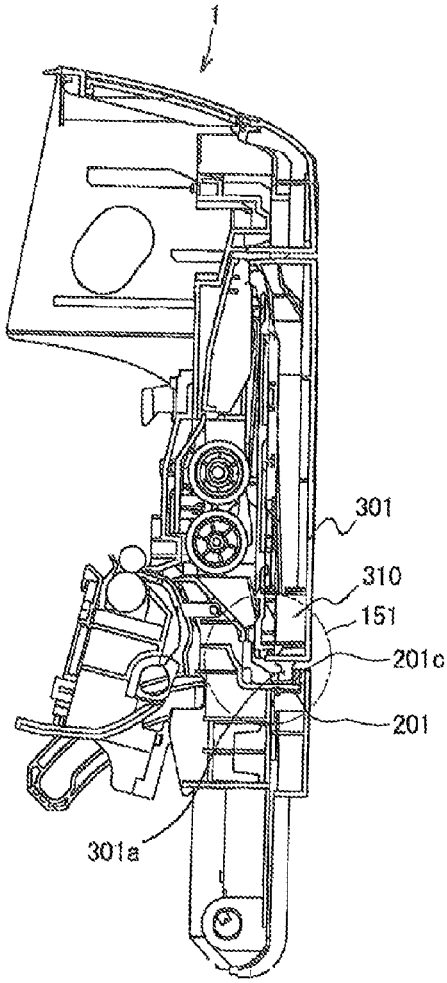
FIG. 13(*a*) is a structural view showing essential structures of the medium conveyance apparatus in which the manual feed tray cover is in the closed position.
Figure 13:
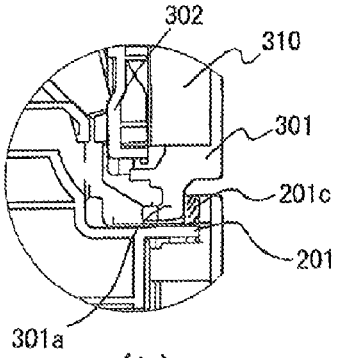

FIG. 12 is an assembly illustration for describing an assembling relation between an apparatus frame 201 and a manual feed tray cover 301 in a medium conveyance apparatus according to a second embodiment, showing a state that the apparatus frame 201 and the manual feed tray cover 301 having a paper mounting plate 302 are separated from each other; FIG. 13(*a*) is a structural view showing essential structures of the medium conveyance apparatus in which the manual feed tray cover 301 is in the closed position; FIG. 13(*b*) is a partly enlarged view of a circled portion 151 drawn by a single dot chain line in FIG. 13(*a*).

Mainly different points between the image forming apparatus using the apparatus frame 201 and the image forming apparatus according to the first embodiment shown in FIG. 1 described above are in that the apparatus frame 201 is added with stopper members 201*c*, 201*d*. Accordingly, the same reference numbers are provided to portions of the image forming apparatus using this apparatus frame 201, which are common with the portions of the image forming apparatus according to the first embodiment described above, or drawings as well as descriptions may be omitted, and the differences are described more specifically.

As shown in FIG. 12, at the apparatus frame 201, the stopper member 201*c* serving as a restricting member is provided at a position facing the fitting portion 101*a* whereas the stopper member 201*d* serving as a restricting member is provided at a position facing the fitting portion 101*b*. Position and shape of each part is structured in a way that, as shown in FIG. 13, the stopper member 201*c* and the projecting portion 301*a* of the manual feed tray cover come in contact with each other whereas the stopper member 201*d* and the projecting portion 301*b* of the manual feed tray cover come in contact with each other, where the manual feed tray cover 301 is in the closed position.

Figure 14:
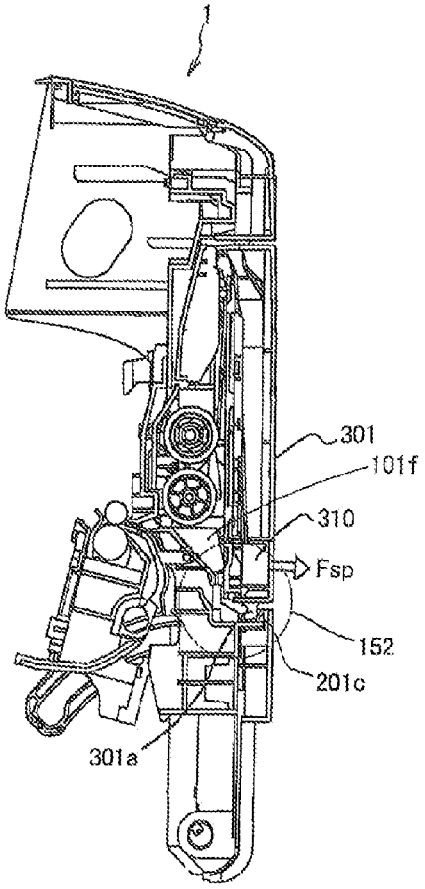
FIG. 14 is a diagram for illustrating effects on each part in the second embodiment.
Figure 14:
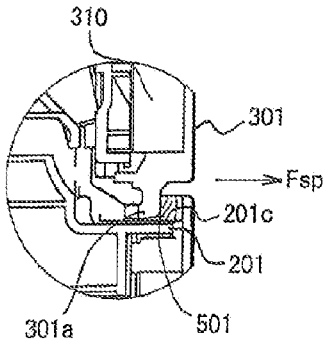

With the structure described above, referring to FIG. 14, operation and effects of each part when the manual feed tray is at the closed position are further described. FIG. 14 is a diagram for illustrating effects on each part in the second embodiment.

As shown in FIG. 14, the spring 310 disposed between the manual feed tray cover 301 and the paper mounting plate 302 is contained in a contracted state upon pushed by the paper mounting plate 302 positionally restricted by a restriction base 101*f* formed at the apparatus frame 201 at a time that the manual feed tray cover 301 is in the closed position. The manual feed tray cover 301, in the closed state shown in FIG. 14, therefore receives force of load Fsp orienting outward by the spring 310 disposed between the projecting portions near the projecting portions 301*a*, 301*b*.

At that time, the projecting portion 301*a* of the manual feed tray cover contacts the stopper member 201*c* whereas the projecting portion 301*b* of the manual feed tray cover contacts the stopper member 201*d*, so that the stopper members 201*c*, 201*d* arranged at the apparatus frame 201 prevent the center of the manual feed tray cover 301 from being bent toward the exterior of the apparatus by the force of load Fsp.

As described above, according to the medium conveyance apparatus in the second embodiment, even where, e.g., the apparatus is left for a long period at a high temperature, load Fsp can restrict the manual feed tray cover 301 from expanding outward. If the manual feed tray cover 301 expands outward, pressure force of the spring 310 may be reduced during feed operation of the recording paper to make lower the paper feed ability, but such an inferior paper feeding performance may be prevented.

In the embodiments, exemplified are that the invention is used for the manual feed tray cover, but this invention is not limited to this structure, and is applicable to ADFs (Auto Document Feeders).

This invention is not limited to the embodiments described above but can be changed or modified in various ways as far as not deviated from the scope and spirit of the invention. For example, the invention is not limited to printers, but also is applicable to image forming apparatuses such as facsimile machines, photocopiers, and MPFs.

What is claimed is:

1. A medium conveyance apparatus comprising:

a frame member secured to a body;

a medium mounting unit for mounting a medium, rotatably attached to the frame member;

a conveying member for conveying the medium rotatably attached to the frame member; and a separating member attached to the frame member and contacting the conveying member, wherein the medium mounting unit includes an engaging portion and the frame member includes an engaged portion engageable with the engaging portion, the engaging portion including an extending portion and a contacting portion, the extending portion extending downstream from a downstream side of the medium mounting unit, toward a conveyance direction of the medium, and the contacting portion extending substantially perpendicularly from a downstream side of the extending portion toward the separating member, and including a contacting surface facing upstream in the conveyance direction of the medium, and the engaged portion including a contacted surface located upstream of the contacting surface in the conveyance direction of the medium, for contacting the contacting surface; and wherein the engaging portion engages the engaged portion when the medium mounting unit is located in an operational position for conveying the medium.

2. The medium conveyance apparatus according to claim 1, wherein the engaged portion includes an opening into which the engaging portion fits, and the contacted portion is formed at a vicinity of the opening, the contacted portion being in contact with the contacting portion fitting into the opening.

3. The medium conveyance apparatus according to claim 1, wherein the engaging portion engages the engaged portion near the separating member.

4. The medium conveyance apparatus according to claim 3, wherein the engaging portion and the engaged portion engage each other on each side of the separating member in a rotation axis direction of the separating member.

5. The medium conveyance apparatus according to claim 1, wherein the conveying member is a feed roller, the separating member is a retard roller producing a prescribed rotation load, and the engaging unit engages the engaged portion near a bearing of the retard roller.

6. The medium conveyance apparatus according to claim 1, wherein the medium mounting unit includes a medium mounting plate for mounting the medium, a cover for movably holding the medium mounting plate, and an urging member formed between the medium mounting plate and the cover for urging the medium mounting plate in a direction that the medium mounting plate moves away from the cover, and the medium mounting unit is pivotable between the operational position and a retracted position at which the cover overlays the medium mounting plate, and wherein the urging member is in a contracted state where the medium mounting unit is located at the retracted position.

7. The medium conveyance apparatus according to claim 1, wherein the medium mounting unit is pivotable between a retracted position, wherein the medium mounting unit is retracted in the body, and the operational position, for conveying the medium, and the frame member further comprising a restricting member contacting the extending portion when the medium mounting unit is in the retracted position.

8. The medium conveyance apparatus according to claim 1, wherein the contacting portion extending substantially perpendicularly stands for that the contacting portion extends at approximately 70 degrees to approximately 120 degrees with respect to the extending portion.

9. The medium conveyance apparatus according to claim 1, wherein the engaging portion is disposed below the separating member in a vertical direction when the medium mounting unit is located in the operational position.

10. An image forming apparatus comprising:

a frame member secured to a body;

a medium mounting unit for mounting a medium, rotatably attached to the frame member;

a conveying member for conveying the medium rotatably attached to the frame member; and a separating member attached to the frame member and contacting the conveying member, wherein the medium mounting unit includes an engaging portion and the frame member includes an engaged portion engageable with the engaging portion, the engaging portion including an extending portion and a contacting portion, the extending portion extending downstream from a downstream side of the medium mounting unit, toward a conveyance direction of the medium, and the contacting portion extending substantially perpendicularly from a downstream side of the extending portion toward the separating member, and including a contacting surface facing upstream in the conveyance direction of the medium, and the engaged portion including a contacted surface located upstream of the contacting surface in the conveyance direction of the medium, for contacting the contacting surface; and wherein the engaging portion engages the engaged portion when the medium mounting unit is located in an operational position for conveying the medium.

11. The image forming apparatus according to claim 10, wherein the engaged portion includes an opening into which the engaging portion fits, and the contacted portion is formed at a vicinity of the opening, the contacted portion being in contact with the contacting portion fitting into the opening.

12. The image forming apparatus according to claim 10, wherein the engaging portion engages the engaged portion near the separating member.

13. The image forming apparatus according to claim 12, wherein the engaging portion and the engaged portion engage each other on each side of the separating member in a rotation axis direction of the separating member.

14. The image forming apparatus according to claim 10, wherein the conveying member is a feed roller, the separating member is a retard roller producing a prescribed rotation load, and the engaging unit engages the engaged portion near a bearing of the retard roller.

15. The image forming apparatus according to claim 10, wherein the medium mounting unit includes a medium mounting plate for mounting the medium, a cover for movably holding the medium mounting plate, and an urging member formed between the medium mounting plate and the cover for urging the medium mounting plate in a direction that the medium mounting plate moves away from the cover, and the medium mounted unit is pivotable between the operational position and a retracted position at which the cover overlays the medium mounting plate, and wherein the urging member is in a contracted state where the medium mounted unit is located at the retracted position.

16. The image forming apparatus according to claim 10, wherein the medium mounting unit is pivotable between a retracted position, wherein the medium mounting unit is retracted in the body, and the operational position, for conveying the medium, and the frame member further comprising a restricting member contacting the extending portion when the medium mounting unit is in the retracted position.

17. The image forming apparatus according to claim 10, wherein the contacting portion extending substantially perpendicularly stands for that the contacting portion extends at approximately 70 degrees to approximately 120 degrees with respect to the extending portion.

18. The image forming apparatus according to claim 10, wherein the engaging portion is disposed below the separating member in a vertical direction when the medium mounting unit is located in the operational position.

* * * * *